US009142085B2

(12) United States Patent
Palexas

(10) Patent No.: US 9,142,085 B2
(45) Date of Patent: Sep. 22, 2015

(54) RANDOM SWITCHING GAME ENGINE FOR WAGERING GAMES

(76) Inventor: Panayis Nicola Palexas, Krugersdorp (ZA)

( * ) Notice: Subject to any disclaimer, the term of this patent is extended or adjusted under 35 U.S.C. 154(b) by 0 days.

(21) Appl. No.: 13/224,522

(22) Filed: Sep. 2, 2011

(65) Prior Publication Data

US 2012/0071221 A1 Mar. 22, 2012

Related U.S. Application Data

(60) Provisional application No. 61/385,117, filed on Sep. 21, 2010.

(51) Int. Cl.
*A63F 9/24* (2006.01)
*G07F 17/32* (2006.01)

(52) U.S. Cl.
CPC ..... *G07F 17/3223* (2013.01)

(58) Field of Classification Search
CPC ... G07F 17/3244; G07F 17/34; G07F 17/326; G07F 17/3213; G07F 17/3223
USPC ..... 463/16–21, 25
See application file for complete search history.

(56) References Cited

U.S. PATENT DOCUMENTS

| | | | | |
|---|---|---|---|---|
| 5,259,616 | A | 11/1993 | Bergmann | |
| 5,380,008 | A | 1/1995 | Mathis et al. | |
| 5,588,913 | A | 12/1996 | Hecht | |
| 5,871,400 | A | 2/1999 | Yfantis | |
| 6,159,096 | A | 12/2000 | Yoseloff | |
| 6,193,607 | B1 | 2/2001 | Kay | |
| 6,264,557 | B1 | 7/2001 | Schneier et al. | |
| 6,533,664 | B1 | 3/2003 | Crumby | |
| 6,663,487 | B1 * | 12/2003 | Ladner | 463/13 |
| 2004/0023715 | A1 * | 2/2004 | Luciano et al. | 463/25 |
| 2005/0176494 | A1 * | 8/2005 | Thomas | 463/25 |
| 2006/0030399 | A1 * | 2/2006 | Baerlocher | 463/20 |
| 2006/0121972 | A1 | 6/2006 | Walker et al. | |
| 2007/0015567 | A1 | 1/2007 | Schugar et al. | |
| 2007/0225057 | A1 | 9/2007 | Moshal | |
| 2007/0265094 | A1 | 11/2007 | Tone et al. | |
| 2008/0004100 | A1 * | 1/2008 | Hein et al. | 463/20 |
| 2008/0076503 | A1 * | 3/2008 | Mattice et al. | 463/16 |
| 2009/0036188 | A1 * | 2/2009 | Gelman | 463/16 |
| 2009/0088252 | A1 * | 4/2009 | Nicely et al. | 463/42 |
| 2009/0108526 | A1 * | 4/2009 | Moody | 273/274 |
| 2009/0253487 | A1 | 10/2009 | Gagner et al. | |
| 2009/0258690 | A1 * | 10/2009 | Tarantino | 463/13 |
| 2010/0248809 | A1 * | 9/2010 | Fitzsimons et al. | 463/20 |
| 2011/0014967 | A1 * | 1/2011 | Yoshizawa | 463/20 |

* cited by examiner

*Primary Examiner* — Steve Rowland
(74) *Attorney, Agent, or Firm* — Weide & Miller, Ltd.

(57) ABSTRACT

A random switching game engine for wagering games provides the advantage of switching between game engines in response to a triggering event. The switch engine controls which game engine will present a wagering game to the player. The different game engines may have different odds for presenting a winning outcome to a player. After a triggering event has occurred the switch game engine may utilize a random number generator to randomly determine whether a switch between game engines should occur. The triggering event may comprise the start of a game or any other event. A switch game engine may perform the switch by activating one of multiple game engines. The wagering game may be presented according to the same rules, but with different odds of receiving a winning outcome, to prevent a player from noticing that a switch between game engines has occurred, or different games may be presented.

19 Claims, 5 Drawing Sheets

RANDOM SWITCHING GAME ENGINE FOR WAGERING GAMES

CROSS-REFERENCE TO RELATED APPLICATION

This application claims priority to U.S. Provisional Application Ser. No. 61/385,117, titled Random Switching Game Engine for Wagering Games, filed Sep. 21, 2010.

BACKGROUND OF THE INVENTION

1. Field of the Invention

The invention relates to electronic wagering games and system, particularly to a switch game engine for wagering games.

2. Related Art

Traditional gaming machines accept a wager from a player and then, when activated, present a wagering event to the player. These wagering events randomly generate game outcomes, some of which are winning outcomes. For instance a random number generator may be used to determine what symbols are presented to the player which determines if the player is a winner or a loser. This results in random outcomes according to set odds during which the player may experience long stretches of losing games. These long stretches may cause the player to wager on another game, or even to stop wagering completely.

In addition, in some jurisdictions, the amount a single winning game pays out may be limited by rules or regulations. This is highly undesirable because a large payout entices players to play, even though the likelihood of achieving a large payout at a gaming machine is low. In jurisdictions where these large payouts are limited, enticement to play is further reduced.

From the discussion that follows, it will become apparent that the present invention addresses the deficiencies associated with the prior art while providing numerous additional advantages and benefits not contemplated or possible with prior art constructions.

SUMMARY OF THE INVENTION

A random switching game engine for wagering games is disclosed herein. In generally, the random switching game engine randomly switches between game engines of a gaming machine. The game engines may have different operational aspects, such as different odds. In this manner, the use of a particular game engine provides different odds to the player. A switch game engine may utilize a triggering event and a random number generator to determine if a switch between game engines should occur. In this way, the switch between game engines may be made random after a triggering event has occurred. The switch game engine helps maintain the excitement of a wagering game by changing the odds of the wagering game over a number of games.

Various configurations are disclosed herein. For example, in one embodiment a gaming machine configured to present one or more wagering games is disclosed. The gaming machine may comprise a plurality of game engines configured to preset the wagering games at the gaming machine, and one or more first random number generators configured to generate one or more first random numbers for the game engines to determine an outcome for the wagering games. Each of the game engines may be configured with different odds for winning.

The gaming machine may also include one or more second random number generators configured to generate one or more second random numbers within a range, and at least one switch game engine having one or more matching numbers. The switch game engine may be configured to activate one of the game engines based on a comparison between the second random numbers and the matching numbers. The activated game engine may be used to present one or more subsequent wagering games.

The first random number generators and the second random number generators may be configured to generate one or more random numbers at the same time. Also, the second random number generators may generate the second random numbers upon the occurrence of a triggering event such as the receipt of a wager from a player, start of a new wagering game, or receipt of a wager of at least a particular predefined amount.

The switch game engine may be configured to activate a different one of the game engines after the activated game engine has presented a predefined number of subsequent wagering games. It is noted that the predefined number of subsequent wagering games may be a random number.

Each of the plurality of game engines may be configured to present the wagering games according to identical game rules. The game engines may also or alternatively be configured to present the wagering games with identical paytables. It is noted that the game engines may comprise a set of game symbols, with each set of game symbols being unique from other sets of game symbols.

In another exemplary embodiment, a gaming machine may comprise a plurality of game engines configured to present one or more wagering games with identical paytables, one or more random number generators configured to generate one or more second random numbers within a range in response to a triggering event, and one or more switch game engines having one or more matching numbers. The outcome of the wagering games may be based on one or more first random numbers. The switch game engines may be configured to activate one of the game engines based on a comparison between the second random numbers and the matching numbers, wherein the activated game engine is used to present one or more subsequent wagering games.

One or more of the game engines may have at least one of the switch game engines associated thereto, whereby an associated switch game engine activates a game engine after the activated game engine has presented the subsequent wagering games.

Each of the game engines may comprise a set of game symbols with each set of game symbols being unique from other sets of game symbols. In addition or alternatively, at least one of the game engines may comprise a set of predefined combinations of game symbols, with the one game engine configured to present each of the set of predefined combinations of game symbols individually. The switch game engines may be configured to activate another of the game engines after each of the set of predefined combinations of game symbols has been presented by the one game engine.

The game engines and switching between game engines may be arranged in various ways. For example, the plurality of game engines may include a first game engine and a last game engine, whereby the switch game engines are configured to activate the first game engine after one or more wagering games have been presented by the last game engine.

A method of presenting one or more wagering games at a gaming machine is also provided herein. As an example, the method may comprise providing a first game engine and a second game engine, accepting a wager from a player, presenting one or more first wagering games with first odds using the first game engine, detecting a triggering event, and generating a random number within a range in response to the triggering event (e.g., start of a new wagering game). Upon matching the random number to one or more matching numbers, one or more second wagering games may be presented with second odds using the second game engine with the second odds being distinct from the first odds (e.g., the second odds may be better for the player than the first odds). The first game engine and the second game engine may be configured to present the wagering games with identical paytables.

Presenting the first wagering games may comprise displaying one or more first game outcomes with a first set of reel strips, while presenting the second wagering games may comprise displaying one or more second game outcomes with a second set of reel strips, where the second set of reel strips are distinct from the first set of reel strips.

The method may also include accepting another wager, and presenting one or more third wagering games with the first game engine after the one or more second games have been presented. In addition or alternatively, the method may include providing a third game engine configured to present the wagering games with identical paytables as that of the first game engine and the second game engine. Upon matching the random number to one or more other matching numbers, one or more third wagering games with third odds may be presented using a third game engine. The third odds may be distinct from the first odds and the second odds.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, disclosed herein is a gaming system with multiple random number generators that generate random numbers. One or more game engines, described below in more detail, present games having different odds or different games, to the player. In one embodiment, the game outcome from an active game engine is determined by the outcome of a first random number generator. Also provided is a switch game engine that selects, through the outcome of a second random number generator outcome, which game engine is designated the active game engine, i.e. which game engine is generating the game results for the player. In this manner, the results or outcome of the game is kept random according to overall odds while allowing some control as to the amount or frequency a player may win.

As will be described further below, the switch game engine may be implemented such that, upon one or more triggering events, the switch game engine "switches" from one game engine to another game engine. This switch between game engines will typically be implemented such that the switch is not perceived by a player. In other words, the game being played may not changed by the switch between game engines though aspect(s) of the game, such as the likelihood of a winning outcome, may be changed for particular games.

Figure 1:
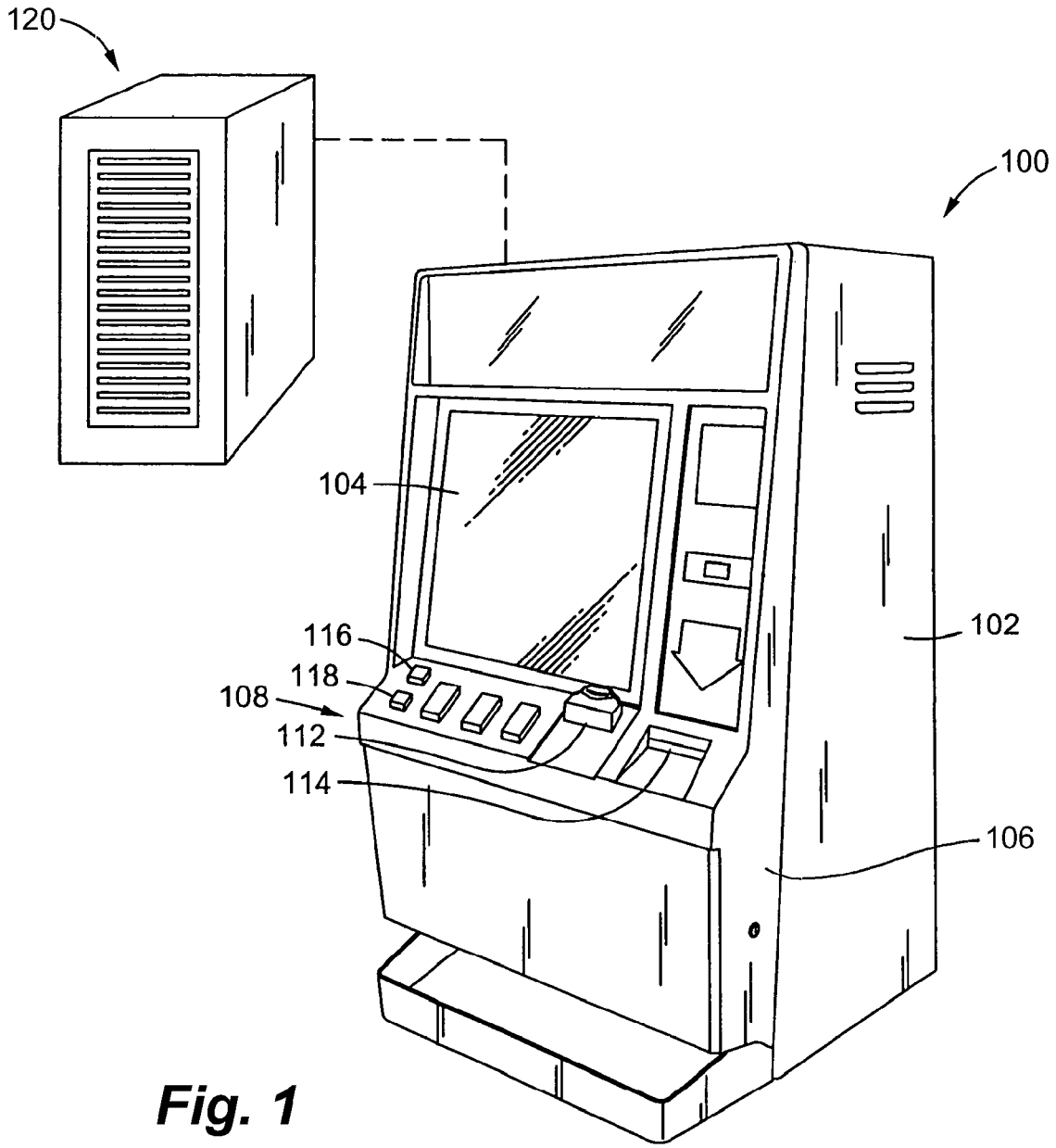
FIG. 1 illustrates an exemplary gaming environment in which a switch game engine may be used.

FIG. 1 illustrates one embodiment of a gaming machine 100 at which the switch game engine may be implemented or used. In one embodiment, the gaming machine 100 is a wager-based gaming machine configured to present one or more games to a player, which games offer the possibility of an award of winnings. Of course, the gaming machine 100 could be configured to present games or amusing activities based upon payment and either not award winnings or offer the opportunity for points, tickets, prizes or the like.

In one embodiment, the gaming machine 100 defines a generally enclosed interior space for housing one or more components. As illustrated, the gaming machine 100 generally comprises a housing or cabinet 102 for supporting and/or enclosing various components required for operation of the gaming machine. In the embodiment illustrated, the housing 102 may include a door 106 located at a front thereof, the door capable of being moved between an open position which allows access to the interior and a closed position in which access to the interior is generally prevented. The configuration of the gaming machine 100 may vary. In the embodiment illustrated, the gaming machine 100 has an "upright" configuration. However, the gaming machine 100 could have other configurations, shapes or dimensions (such as being of a "slant"-type or other configuration as is well known to those of skill in the art). It is noted that the configuration of the door 106 may vary, such as dependent upon the configuration of the gaming machine 100.

The gaming machine 100 preferably includes at least one display device 104 configured to display game information. The display device 104 may be a mechanical, electro-mechanical or electronic display, such as one or more rotating reels, a video display or the like. When the display device 104 is an electronic video display, it may comprise a cathode ray tube (CRT), high resolution flat panel liquid crystal display (LCD), projection LCD, plasma display, field emission display, digital micro-mirror display (DMD), digital light processing display (DLP), LCD touchscreen, a light emitting display (LED) or other suitable displays now known or later developed, in a variety of resolutions, sizes and formats (e.g. 4:3, widescreen or the like). The display 104 may be capable of projecting or displaying a wide variety of information, including images, symbols and other indicia or information associated with game play, game promotion or other events. In one embodiment, the display 104 may be used to present one or more paytables associated with the opportunity for increased awards. It is contemplated that more than one display 104 may be provided in a gaming machine. Each display 104 may present different information. For example, a display 104 may be used to present one or more paytables while another display is used to present a game.

The gaming machine 100 may be configured to present various styles or configurations of games having the inventive features described herein. These may include games in Class III, such as video poker games, keno, slot-type games, and blackjack or other card, dice or various other games now known or later developed, as well as games in Class II, including central determinant games such a video lottery, bingo and bingo-based games, and other games now known or later developed. The games may also be skill based or include one or more skill components. In one embodiment, certain game outcomes may be designated as winning outcomes. Awards may be provided for winning outcomes, such as monetary payments (or representations thereof, such as award of credits), prizes or the like. As is well known in the art, the number of winning outcomes may vary dependent upon the desired payout or winning percentage offered to the players as compared to wagers that are retained by the gaming establishment.

The gaming machine 100 may include one or more player input devices 108 (such as input buttons, a touch-screen display, joystick, touch-pad or the like) that may be utilized by the player to facilitate game play. The gaming machine 100 may include a coin accepting mechanism 112 for accepting coins and/or a currency or bill acceptor 114 for accepting cash or paper currency. It is also contemplated that other mechanisms may be provided for accepting value for game play, such as credit card, ticket readers or input devices whereby a player may have funds paid from a remote account. The gaming machine 100 may also include a "bet credit" button 118 or the like, such as to permit a player to wager monetary credits credited to the machine.

In one preferred embodiment, the gaming machine 100 includes one or more microprocessors or controllers for controlling the gaming machine, including receiving player input and sending output signals for controlling the various components of the machine 100 (such as generating game information for display by the display 104). The controller may be arranged to send signals for determining winning combinations and to cause the display 104 to display winning amount information. In addition, the controller is preferably arranged to determine if a round of game play has resulted in a win, and if so, the amount to be paid to the player for that win.

The gaming machine 100 may include a means for paying a player any winnings accumulated during game play. For example, a "cash out" button 116 may be provided for permitting a player to be paid the winnings or redeeming any credits initially paid into the gaming machine 100. The term "cash out" is used herein to define an event initiated by the player wherein the player receives a number of coins or currency that is equivalent to the value of the player's accrued credit base. Typically when a player cashes out, the player receives either a paper currency voucher or currency in the form of a coin disbursement. If the player decides to receive a coin disbursement, the gaming machine 100 may activate a coin hopper or coin handling device (not shown) which physically counts and delivers the proper number of coins to the player. The coin handling device is commonly configured to transport coins from a supply source (hopper or bin filled with coins) to a coin tray or payout receptacle where the player physically receives the coins. The player might also elect to cash out by having a ticket or other media dispensed, such as via a printer.

The gaming machine 100 may be configured as a standalone device or be in communication with one or more external devices at one or more times. For example, the gaming machine 100 may be configured as a server based device and obtain game code or game outcome information from a remote server. The gaming machine 100 may also communicate with one or more gaming servers 120. These one or more gaming servers 120 may be configured to perform accounting, player tracking, bonusing, game generation, or other functions.

In one embodiment, a gaming machine 100 may include various hardware and/or software for implementing the opportunity for increased awards. For example, one or more player input devices 108 may be provided for implementing the opportunity. In one embodiment, an "accept" player input device 108 may be provided to allow a player to accept the opportunity for increased awards. Once the opportunity is accepted, the player may be presented an updated or new paytable including one or more increased awards. It is contemplated that a "decline" player input device 108 may also be provided to allow the player to decline the opportunity. The player input devices 108 may be physical buttons or touch buttons on a display 104 in one or more embodiments.

Figure 2:
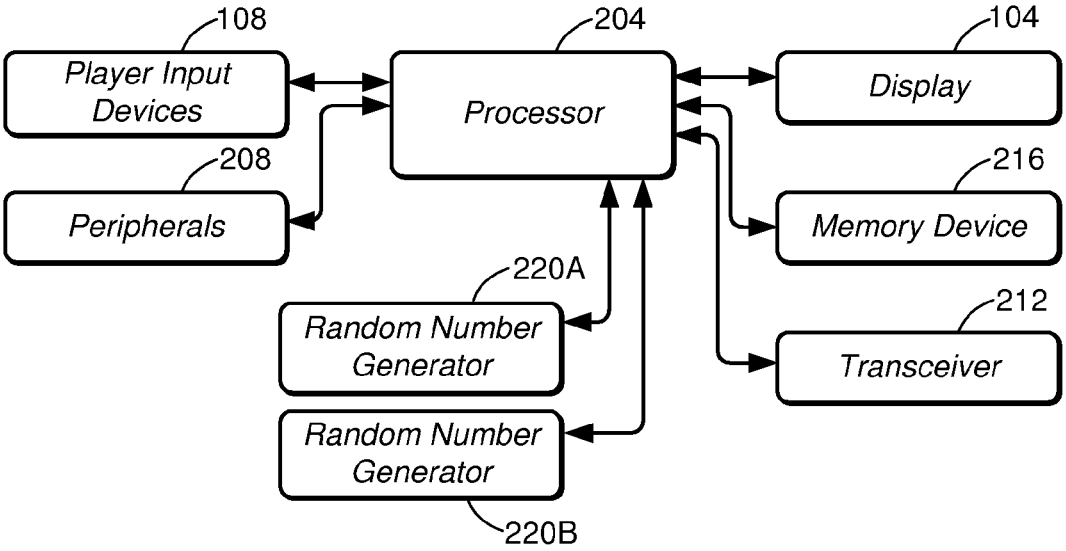
FIG. 2 is a block diagram illustrating components of an exemplary gaming machine through which a switch game engine may be implemented.

FIG. 2 illustrates the components of an exemplary gaming machine. As shown, the gaming machine comprises a processor 204, display 104, a memory device 216, and one or more player input devices 108. In general, the processor 204 may be a microprocessor, circuit, controller, or the like configured to process input and generate output to present one or more games. The processor 204 may execute machine readable code to present one or more games. Output from the processor 204 may be used to control or communicate with other components connected to the processor such as a display 104, transceiver 212, or gaming machine peripherals 208. A processor 204 may accept input from one or more player input devices 108 or other components connected to the processor, such as to allow play of a game.

In one or more embodiments, the processor 204 may be connected to a memory device 216 configured to store data. The memory device 216 may be various types of electronic memory, now known or later developed, including but not limited to magnetic, flash, or optical memory. It is contemplated that the memory device 216 may be remote from the gaming machine in some embodiments, but may be accessible such as via a network or other communication link. For example, a memory device 216 may be in a server or other device that is remotely accessible to the gaming machine. It is noted that a processor 204 may include its own memory in some embodiments. It is also noted that machine readable code used by the processor, or a portion thereof, could be hardwired into the circuitry of a processor 204. In such embodiments, a separate memory device 216 may not be required.

The memory device 216 may be configured to store the machine readable code for one or more games. It is contemplated that a memory device 216 may also be configured to store information for one or more games, the switch game engine, or both. For example, information related to the play or execution of a game and the switch game engine such as but not limited to credits, amounts wagered, amounts won, one or more paytables, winning outcomes, award amounts, paylines, symbol positions, cards/symbols dealt, jackpot amounts, bonuses, and randomly generated numbers may be stored in the memory device 216. This and other information may be stored in the memory device 216 for a period of time to allow past events to trigger activation of the switch game engine.

In one or more embodiments, a gaming machine may be configured with multiple game engines. In general, is the hardware, software, or both that generates a game outcome. For example, a game engine includes the hardware and/or machine readable code necessary to present a game to a player, accept player input according to the rules of the game, and provide an outcome to the player. In one embodiment, the only difference between two game engines is the odds of receiving winning outcomes. In other embodiments any other aspect of a game may vary between game engines, include the game itself. For example, in one or more embodiments, the game engine may be configured to present a video poker, blackjack game, or other card game. Alternatively or in addition, the game engine may be configured to present a slot game.

Typically, each game engine will have a different set of odds for achieving winning outcomes. Though various aspects of each game engine may differ, typically, each game engine will be configured to present the same game according to the same rules. In addition, a predefined winning outcome or predefined set of winning outcomes (e.g., a paytable) may remain the same between multiple game engines. In this manner, a switch between game engines may result in a change to the odds but not to the play of a game. Also, in this manner, a switch between game engines is difficult if not impossible for a player to perceive.

Each game engine may be a self-contained separate entity. For example, each game engine may have its own machine readable code and/or hardware. To illustrate, each game engine may have its own processor 204, memory device 216, and/or machine readable code. Alternatively, some elements of a game engine may be shared with one or more other game engines. For example, machine readable code and/or hardware used to present a game according to the rules of the game may be shared between game engines. To illustrate, a single processor 204 and/or the same memory device 216 may be used to execute different game engines. In this embodiment the only difference between game engines is the odds of receiving a winning outcome or the paytable.

Thus the only difference may be a software or data table accessed. Elements involving the odds of the game may remain separate. For example, different reel strips, sets of game symbols/indicia, or the like may be associated with particular game engines. Alternatively or in addition, a game engine may have its own random number generator. In some embodiments, a game engine may have a set of predefined outcomes that it presents in a consecutive or a random order. The above game engine elements alter the likelihood that a winning outcome or combination will be presented to a player thus changing the odds of the game.

It is noted that the differences between these elements may define the different game engines in some embodiments. The one or more winning outcomes (e.g., paytable) for a game will, in one embodiment, not be altered by the switch between game engines even though this would change the odds of the game. Use of the same payable is advantageous in that the play of the game is not altered by the switch between game engines. In addition, this prevents a player from noticing the switch, which preserves the excitement provided by the randomness of outcomes at the gaming machine.

The memory device 216 may alternatively or additionally store machine readable code to implement a switch game engine. A switch game engine comprises software, hardware, or both that determines if and when the gaming machine changes to a different game engine. In this manner, the processor 204 may retrieve and execute machine readable code to provide the switch game engine's features or functionality. In connection with the random output from second random number generator, the switch game engine generates a control signal that determines if and when to switch to a different game engine, i.e. make a different game engine the active game engine. The switch game engine may select from two or more game engines. Alternatively, though not shown in FIG. 2, the switch game engine may be a separate hardware component or components in communication with a processor 204 or other element of a gaming machine.

In one or more embodiments, when activated, the switch game engine may be used to randomly switch between game engines. Typically, an event or occurrence will be used to trigger activation of the switch game engine. Once activated, the switch game engine may randomly determine whether or not a different game engine should be used to present one or more subsequent games. In one embodiment, the switch game engine activates everytime a game is played, and upon generation of a particular random number, or range of random numbers, the switch game engine causes a different game engine to be the active game engine.

To allow this random determination, a gaming machine with the switch game engine may use at least two random number generators 220A, 220B. In one or more embodiments, a first random number generator 220A may be configured to provide one or more random numbers to one or more game engines, such as to facilitate presentation and determination of the outcome of one or more games. A second random number generator 220B may be used by the switch game engine to perform its random switching function to select which is the active game engine. Though it is possible, in such embodiments, the random number generators will typically not be shared between a game engine and a switch game engine. As described below in greater detail, the switch game engine will be configured with odds that control the frequency of selecting a different game engine.

As will be described further below, upon activation, the switch game engine may receive a random number from a second random number generator. If the random number matches one or more matching numbers, as may be defined by or provided to the switch game engine, the switch game engine may cause a switch to be made from one game engine to another game engine. The second random number generator may be set to generate random numbers within a predefined range of numbers and these generated random number are processed by software code to determine the odds of a switch between game engines. Likewise, the number and/or range of matching numbers, which are compared to the generated random number, may be set to control the odds of a switch between game engines.

The random number generators 220A, 220B may accept one or more seed values in one or more embodiments from which one or more random numbers may be generated. The seed value may represent various tangible objects or characteristics. For example, a measurement of vibration, temperature, voltage, or time may be used as a seed value. In some embodiments, the random number generators 220A, 220B may include or be connected to one or more sensors or the like to measure these or other values for use as seed values. It is noted that the random number generators 220A, 220B may be separate components or be implemented by another component, such as a processor 204 and/or machine readable code, in one or more embodiments. It is also noted that in server based gaming environments, that one or more of the random number generators 220A, 220B may be remote from one or more gaming machines and that the random numbers generated by the random number generator may be communicated to the gaming machines and/or game outcomes may be provided to the gaming machine.

In some embodiments, an activator component may be provided. The activator may be configured to monitor information from the gaming machine, server, or other device where triggering events may occur. When a trigger or triggering event is detected by the activator, the activator may activate a switch game engine, such as by signaling the switch game engine or a random number generator associated with the switch game engine. The activator may constantly monitor for triggering events or periodically check for triggering events. The activator may be in communication with various components of the gaming machine, server, or other device where triggering events may occur so as to be able to monitor for the triggering events. The trigger event may comprise input from a player to start a wagering event.

The gaming machine may also comprise one or more peripherals 208 to facilitate play of a game such as card readers, coin acceptors, bill acceptors, coin hoppers, ticket/receipt printers or dispensers, and the like, as detailed above. The gaming machine may also include a transceiver 212 to allow the gaming machine to communicate with external devices such as other gaming machines, game controllers, progressive controllers, gaming servers, and the like. The transceiver 212 may allow wired or wireless communications via one or more network or other connections. It will be understood that the switch game engine may be implemented in various embodiments of gaming machines that may include additional or other electronic components, or that may not require one or more of the components illustrated in FIG. 2.

Figure 3:
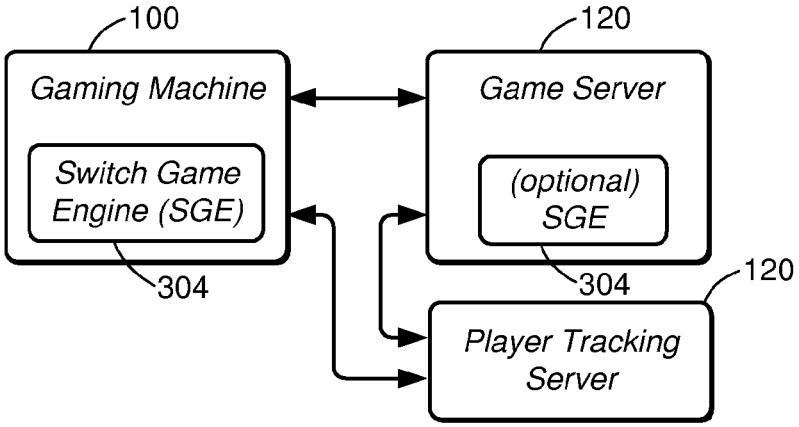
FIG. 3 is a block diagram illustrating an exemplary gaming environment in which a switch game engine may be used.

FIG. 3 provides a high level view of the switch game engine relative to other gaming equipment. In the block diagram of FIG. 3, it can be seen that the switch game engine 304 may be used in a networked or server-based gaming environment. As can also be seen, the switch game engine 304 may be at various locations. In one embodiment, the switch game engine 304 may be at a gaming machine 100. In another embodiment, such as a server-based embodiment, the switch game engine 304 may be at a game server 120 or other remote server. It is noted that the switch game engine 304 may be at both the gaming machine 100 and the game server 120 in some embodiments such as to provide redundancy in the event of a failure of one switch game engine.

In addition, as will be described further below, a plurality of switch game engines 304 may be used in some embodiments. In these embodiments, any switch game engine(s) 304 in the gaming machine 100 and/or server 120 could be used during play of a game. To illustrate, in FIG. 3, the switch game engine 304 of the gaming machine 100 and the switch game engine of the sever 120 could both be used. For example, one switch game engine may be used to switch to a particular game engine, while the other switch game engine is used to switch from that game engine to another game engine.

A gaming machine 100 utilizing a switch game engine 304 may be used with various player tracking systems. For instance, as shown, the gaming machine 100 is in communication with a player tracking server 120. In this manner, various aspects of games played using a switch game engine may be tracked for player rewards, loyalty programs, bonuses, or the like. In one embodiment, tracking information for a player may be used to "remember" or keep a record of the player's wins and losses. This tracking information may be used to trigger activation of a switch game engine. For example, if tracking information shows the player has not received a winning outcome for a particular number of games, a switch game engine may be activated to determine whether or not a different game engine (perhaps with odds more favorable to the player) may be used for one or more subsequent games. This may also occure, as described herein, without tracking or relation to prior game win/loss history.

Since a switch game engine 304 may be in communication with a gaming machine 100, server 120, or both, information from these devices may be used to trigger activation of the switch game engine (in addition or instead of tracking information). For example, the collection or acceptance of a wager from a player or a wager of a particular amount, of at least a particular amount, or within a particular range may trigger activation of the switch game engine.

Figure 4A:
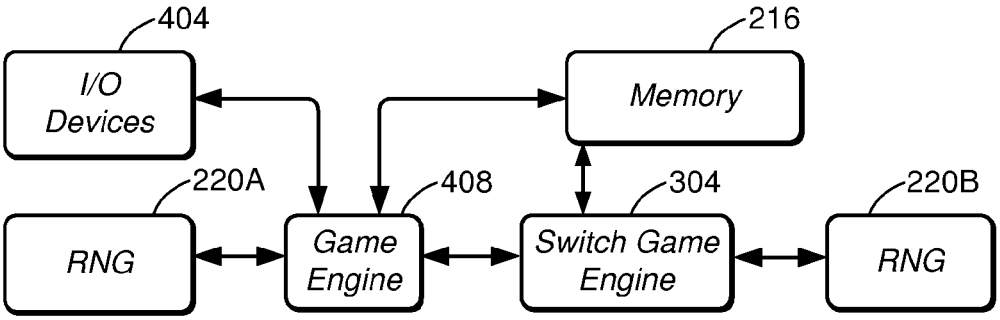
FIG. 4A-4C are a block diagrams illustrating exemplary gaming machines in which a switch game engine may be used.
Figure 4B:
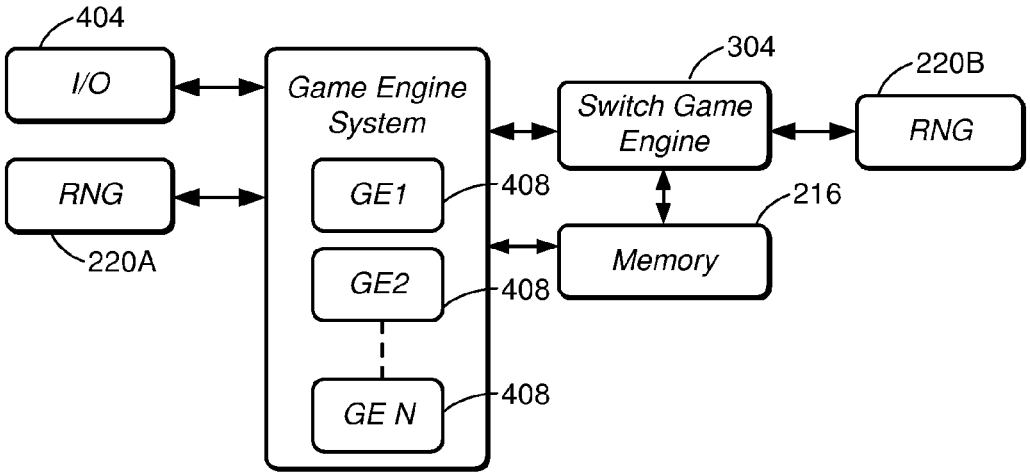
Figure 4C:
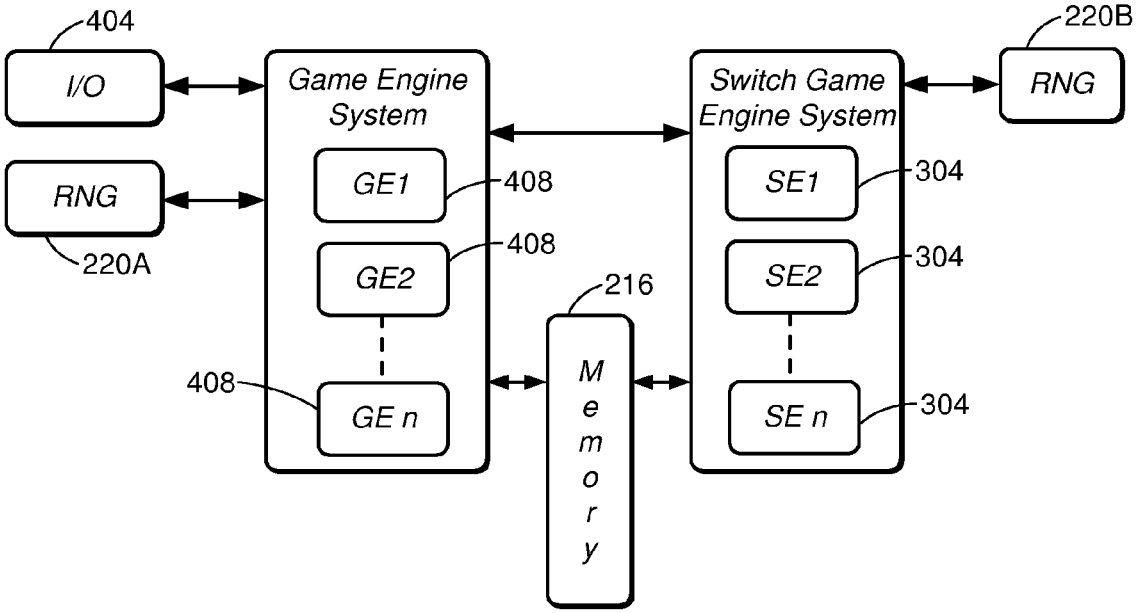

FIGS. 4A-4C illustrate lower level views of one or more switch game engines 304 relative to other elements of a gaming machine or used by/accessible to a gaming machine. Referring to the embodiment of FIG. 4A, the gaming machine may include I/O devices 404, memory 216, a game engine 408, and a switch game engine 304. At least two random number generators 220A, 220B may be provided in one or more embodiments.

It is noted that the I/O devices 404 may be various devices which provide input and/or output to the game engine 408. Typically, the I/O devices 404 will be devices that allow user input or present output to a user to allow play of a game. For example, the I/O devices 404 may comprise one or more player input devices, peripherals, displays, and/or transceivers, such as described above.

As stated, the game engine 408 may be configured to present one or more games. The game engine 408 may receive player input from an I/O device 404 to allow a player to interact with the game. Typically, the game engine 408 will be in communication with a random number generator 220A. The game engine 408 can then use random numbers to provide random outcomes for its games.

The game engine 408 may also be in communication with the switch game engine 304. The game engine 408 may share information regarding a game with the switch game engine 304 in any manner. As described above, such information may be used to trigger activation of the switch game engine 304. It is contemplated that the switch game engine 304 may retrieve this information from the game engine 408 or that the game engine may alert or notify the switch game engine as to the occurrence of particular events before, after, or during a game.

Communication with the switch game engine 304 also allows the switch game engine to signal the game engine 304 to switch to a different game. It is contemplated that a single game engine 408, as shown in FIG. 4A, may execute different games or implements different odds for the same game by receiving data from the memory 216. As described above, such a switch may also be between two or more game engines. In embodiments with a single game engine 408, the switch may cause the game engine to change one or more aspects of its operation, rather than switching between game engines. The change(s) may remain active for one or more subsequent games. For example, the change may remain for a particular number of games, a particular period of time, and/or until the switch game engine 304 signals the game engine 408 to change again.

In one or more embodiments, the switch game engine 304 may send a signal to the game engine 408 to change its odds. A game may then be presented according to the changed odds until the game engine 408 changes back to the original odds or to another value for the odds. This is advantageous in that changing the odds allows the likelihood of winning to be altered in favor of the player or in favor of the gaming establishment.

One advantage of the switch game engine is now described. To illustrate, a random number generator 220B associated with the switch game engine 304 may be set such that it generates a random number that activates the switch game engine a particular number of times for a particular number of games. For example, the random number generator 220B may be set to generate random numbers between 1 and 100, inclusive. The switch game engine 304 may be set to activate upon receiving a matching number between 1 and 5, inclusive. In this manner, the switch game engine 304 may change to a second game engine 5 times for every 100 games. If the odds of winning when playing when the second game engine is active are greater than if the first game engine is active, then this has the overall affect of changing the odds of the game and the effective payout rate.

For example, when the switch game engine 304 signals the game engine 408 to, for example, alter the odds of a game in favor of the player the chances of a winning outcome within 100 games may be increased. This is beneficial in that a player playing the game will obtain the benefit of better odds during a set of 100 games, in this example, 5 out of 100 games on average. Once the odds are improved, the player may experience one or multiple winning outcomes. The chance of a long stretch of games without a winning outcome is thus reduced. This rewards the player and can keep the player from leaving the machine. The number of matching numbers and the range of random numbers may be tuned to produce particular overall odds for the game.

It is contemplated that the amount the odds are changed may vary. Although possible and contemplated, the odds typically will not be changed to an extent that a winning outcome or losing outcome is guaranteed. However, the odds may be changed such that a winning or losing outcome is extremely likely. For example, the odds provided by the game engine 408 may be changed to give the player a 90% or higher chance of a winning outcome. Alternatively, the odds may be changed to give the player a 10% or lower chance of a winning outcome. By changing the odds to 90% chance of winning, the player experiences a very high likelihood of multiple payouts which have the agreegate effect of a single large payout. This in turn encourages game play by providing the opportunity for a large payout comprising multiple successive small payouts.

FIG. 4B illustrates an embodiment where a switch game engine 304 is used with a plurality of game engines 408. As can be seen, there can be two game engines all the way up to N game engines, where N is a positive integer. Typically, the individual game engines 408 will have one or more distinct aspects of operation relative to one another, while being configured to present the same game.

For example, game engine 1 (GE1) may be configured to provide X % odds of winning, game engine 2 (GE2) may be configured to provide Y % odds of winning, game engine 3 (GE3) may provide Z % odds of winning, and so on and so forth. It is noted there may only be two game engines in some embodiments while other embodiments may have any number of game engines.

The game engines 408 may have various other aspects which are distinct. For example, GE1 may have better odds for the player to win particular winning outcomes. In a slot-type game for example, GE1 may have X % odds for a player to obtain a winning outcome. GE2 may have Y % odds (i.e., different odds) for the player to obtain a winning outcome. It will be understood, given this example, that the various game engines 408 may have different odds for one, some, or all possible winning outcomes.

The switch game engine 304 may be configured to switch the gaming machine to one of the game engines 408 based on information received from its random number generator 220B. For example, random numbers within a first range may cause the switch game engine 304 to activate GE1 while random numbers within another range cause the switch game engine 304 to activate GE2. Random numbers within other predefined ranges may activate one or more other game engines 408, if provided in the gaming machine.

FIG. 4C illustrates an embodiment where multiple switch game engines 304 may be used to activate one or more game engines 408. As can be seen from FIG. 4C, there may be two, three, or up to N switch game engines 304 in one or more embodiments, where N is a positive integer. It is noted that though shown with a random number generator 220A in communication with the game engines 408 and a random number generator 220B in communication with the switch game engines 304, there may be additional random number generators. For example, each game engine 408 or switch game engine 304 may have its own random number generator. Alternatively, the switch game engines 304 may share one or more random number generators. Likewise, the game engines 408 may share one or more random number generators.

In embodiments having multiple switch game engines 304, individual switch game engines may be used at different times. For example, switch game engine 1 (SGE1) may be used if GE1 is currently active, while switch game engine 2 (SGE2) may be used if GE2 is currently active, and so on and so forth. Each switch game engine 304 may have their own matching number or numbers, their own random number generator, or both. In this manner, the likelihood of a switch may be different depending on the switch game engine 304 being used.

The use of multiple switch game engines 304 allows various arrangements of game engines 408. For example, there may be a circular arrangement where GE1 and SGE1 switches to GE2 and SGE2. SGE2 could be configured to switch to GE3 and SGE3, which may be configured to switch back to GE1 and SGE1. In this manner, players would cycle through the game engines in a "circular", fixed, or random order. In one embodiment, the game engines, GE1, GE2, and GE3, could provide increasingly better odds to the player until the cycle is complete and a switch is made back to GE1. It is noted that though described with regard to three game engines, the circular arrangement may be made with two, three, or more game engines and switch game engines.

As another example, a ladder arrangement of game engines 408 could be set up with multiple switch game engines 304. For example, GE1 and SGE1 may switch to GE2 if one or more triggering events have occurred. For example, if the player has achieved a particular outcome, SGE1 may (if the appropriate matching number(s) is received) switch to GE2 and SGE2. If not, GE1 may remain active. From GE2, SGE2 may switch to GE3 and SGE3 if another or the same particular outcome is achieved. If not, SGE2 may switch back to GE1. It is noted that, like the circular arrangement, the ladder arrangement may include two or more game engines. In addition, a portion of a game engine arrangement may be circular while another portion is a ladder arrangement. It is contemplated that various other game engine arrangements may be made with different triggering events and switch game engines 304.

Multiple switch game engines 304 may also be used at the same time. The switch game engines 304 may each have a different range or set of matching number(s) and be configured to cause a switch to a distinct game engine 408. For example, SGE1, SGE2, and SGE3, may all operate when GE1 is active and may respectively cause a switch to GE2, GE3, and GE4 depending on the random number received by the switch game engines 304. Though this example uses three switch game engines 304 it is noted that two or more switch game engines may be used in this manner.

It is contemplated that the switch game engines 304 may have overlapping ranges or sets of matching numbers in some embodiments. For example, SGE1 may have a matching numbers 1-5 and SGE2 may have matching numbers 5-10. In such an embodiment, a conflict resolution system may be used to determine which engine will make the switch. For example, a hierarchy between switch game engines 304 may be established with higher ranking switch game engines taking precedent.

Figure 5:
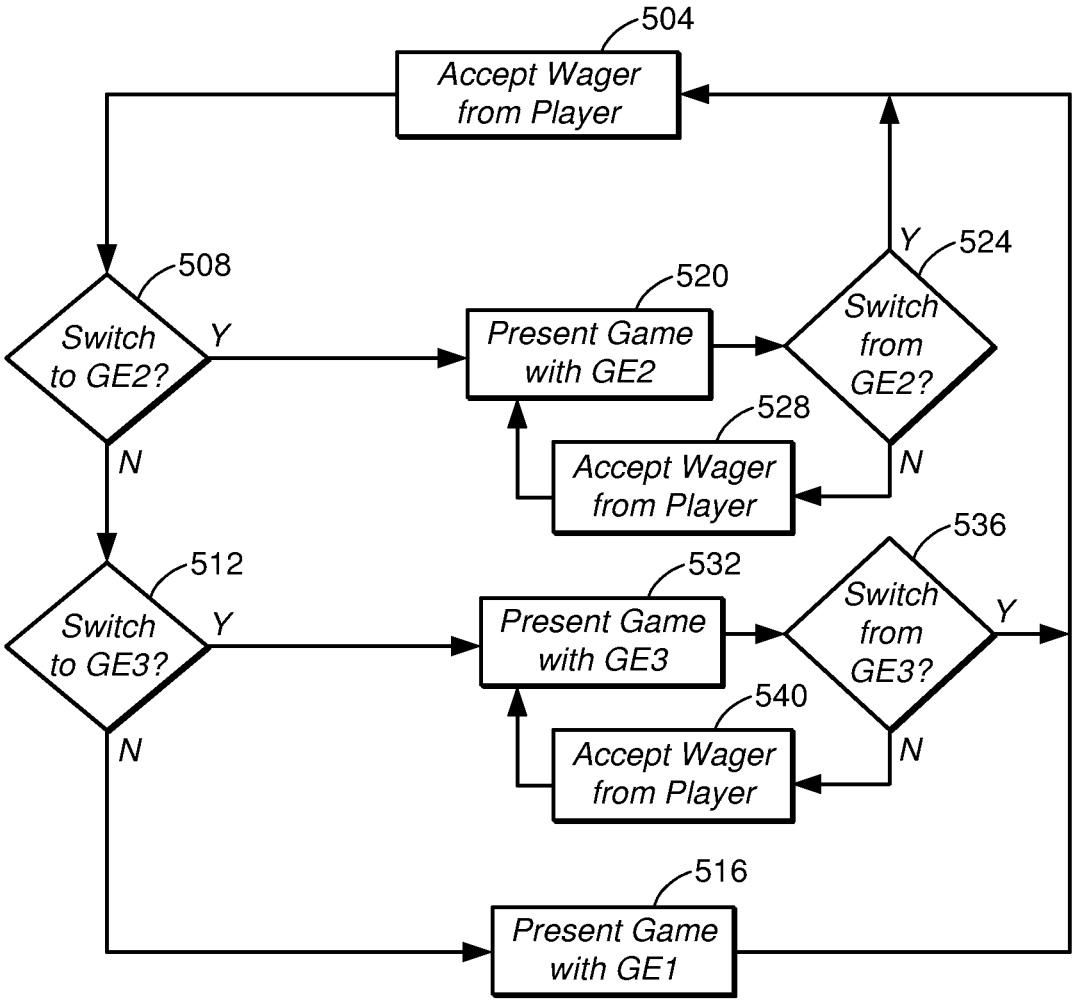
FIG. 5 is a flow diagram illustrating operation of an exemplary switch game engine.

FIG. 5 is a flow diagram illustrating an exemplary method of operation of a gaming machine when enhanced with one or more switch game engines. As will be described further below, the exemplary steps illustrated in FIG. 5 allow a gaming machine to switch between three game engines.

In the steps below, a determination as to which game engine to use relied upon. This determination may be made by activating a switch game engine to determine if a switch should be made, which game engine to switch to, or both. If a switch is not to be made, the current game engine may continue to be used. As discussed above, the switch game engine may be activated by a trigger or triggering event. Once activated, the switch game engine may compare a random number to its set of matching number(s) to determine if a switch should be made.

Triggers may be a variety of events that may occur during play of a game. For example, the initialization or start of a game may be a trigger. Alternatively, a wager of a particular amount or larger or smaller than a particular amount may be a trigger. A number of games played without a winning outcome may be a trigger as well. A particular duration of time since the last winning outcome may also be a trigger. In addition, a particular winning outcome may be a trigger. It is noted that triggers need not be events directly related to a game in some embodiments. For example, a particular time of day may be a trigger, or a jackpot above, below, or equal to a particular amount may be a trigger. Different switch game engines may have different or the same trigger or triggers.

The determination of which game engine to use may occur whenever a trigger occurs even if the trigger occurs before, during, or after a game. The actual switch from one game engine to another may occur before the next game begins. Data indicating whether a switch should be made, which game engine to switch to, or both may be stored in cases where the determination is made prior to the time for switching game engines.

The steps of FIG. 5 will now be described. At a step 504, a wager may be collected from a player. In general, this permits the player to play one or more games at the gaming machine. At a decision step 508 a switch between game engines may, but does not have to occur. For example, at decision step 508, if a triggering event has occurred and a determination has been made to switch to GE2, the switch game engine may switch to GE2 at a step 520 for presentation of one or more games to a player. Alternatively, at a decision step 512, the switch game engine may switch to GE3 at a step 532 for presentation of one or more games. If neither GE2 nor GE3 are used, a default game engine, such as GE1 may be used to present one or more games at a step 516.

As stated, a game engine may be used to present a number of games before switching to another game engine. In one or more embodiments, the number of games a game engine presents may vary. This is illustrated in FIG. 5. For example, once GE2 has been selected, a game may be presented with GE2 at step 520. At a decision step 524, it may be determined whether or not the same or a different game engine should be used for one or more subsequent games. If the same game engine should be used then a wager for the next game may optionally be collected at a step 528. Another game may be presented by GE2 at step 520.

To briefly reiterate, the number of games presented by a game engine may be predetermined, random, or based on the occurrence of a trigger. In a predetermined embodiment, GE2 may be used for a set number of games. When that number of games have been played decision step 524 may cause the gaming machine to cease using GE2 by proceeding to step 504. In another predetermined embodiment, GE2 may be configured to present a set of predefined outcomes. For example, in a slot game, GE2 may present preset combinations of symbols when its reels stop spinning. Once each preset combination has been presented (in consecutive or random order), decision step 524 may cause the gaming machine to cease using GE2 by proceeding to step 504.

In a random embodiment, GE2 may be used for a random number of games. A random number generator may be used to set the number of games. A range may be provided to the random number generator to prevent GE2 from presenting a number of games beyond a particular number.

In an embodiment based on the occurrence of a trigger, GE2 may present one or more games until a trigger occurs, which causes another game engine to be used. For example, the start of every game with GE2 may trigger activation of a switch game engine. If the switch game engine receives a matching random number, it may switch game engines at step 524 by ceasing use of GE2 and proceeding to step 504. As discussed above, a trigger may be various events. For example, rather than the start of a game, achieving a winning outcome or a particular winning outcome may trigger activation of the switch game engine.

After decision step 524, if the same game engine, GE2, is not to be used, the process may continue to step 504 where a wager may be collected for the next game. After the wager is collected, decision step 508 and/or decision step 512 may determine which of the game engines will present the next game, as discussed above.

Likewise, a predetermined, random, or trigger-determined number of games may be presented by GE3. For instance, at step 532 a game may be presented with GE3. Subsequently, it may be determined at a step 536 whether a different game engine should be used for an additional game. If not, a wager may be collected for the next game at a step 540 and another game may be presented by GE3 at step 532. If yes, the process may continue at step 504 with collection of another wager. Decision step 508 and decision step 512 may then determine which game engine is to be used for the next game, such as described above.

The embodiment of FIG. 5 will now be described according to an exemplary gaming machine implementation. The game engines of the exemplary implementation may correspond to different states of a game. For example, GE1 may be a normal or default game engine, GE2 may be an enhanced game engine, and GE3 may be a super enhanced game engine. As described in the following, the enhanced game engine may provide improved odds to the player while the super enhanced game engine may provide even better odds to the player. It is noted that each game engine may provide odds as desired, including odds that are not as favorable to the player.

At step 504, a wager may be collected from a player to begin play of a game. This may trigger activation of a switch game engine where a random number may be used at to determine if the gaming machine should switch to GE2. For example, if the random number matches a particular number or falls within a predetermined range of numbers, a switch may be made to GE2 at step 520. To illustrate, the random number generator may randomly provide numbers in a range between 1 and 100, inclusive. If one matching number is selected from this range, the player will get enhanced odds (via activation of GE2) 1 out of every 100 games. If additional matching numbers or a range of matching numbers are selected, the player will get enhanced odds for a larger number of every 100 games. For example, if the range 1-10 is used, the player will get enhanced odds for 10 out of every 100 games.

Likewise, with regard to decision step 512, a random number, or the same random number generated above may be used by a switch game engine to determine whether or not to switch to GE3. Since GE3 provides super enhanced odds, the likelihood of GE3 being activated may be set such that there is a lower probability of activating GE3. For example, a fewer number of matching numbers may be selected for activating GE3 as compared to the number of matching numbers for activating GE2. To illustrate, a random number in the range 1-10 may activate GE2, while a random number in the range 11-15 may activate GE3. GE2 or GE3 (as appropriate) may then be used for one or more subsequent games before switching to another game engine.

Figure 6:
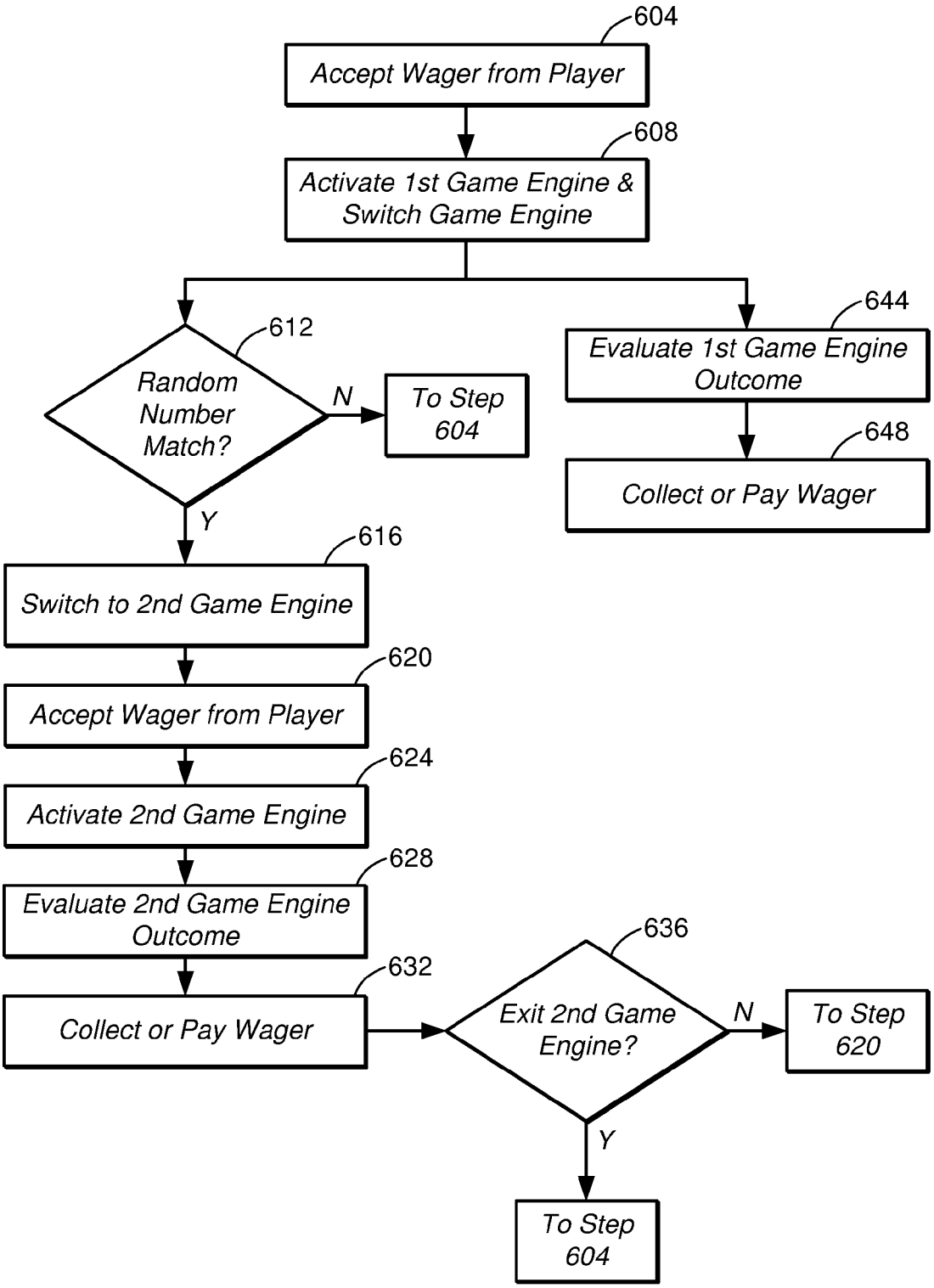
FIG. 6 is a flow diagram illustrating operation of an exemplary switch game engine and two game engines.

FIG. 6 is a exemplary flow diagram illustrating operation of an exemplary gaming machine where a switch occurs between a first game engine and a second game engine. As can be seen, at a step 604, a wager may be received or accepted from a player. At a step 608, a first game engine and a switch game engine may be activated. The first game engine may produce an outcome for the game that may be evaluated at a step 644. Typically, the first game engine will use one or more random numbers to produce the outcome. As discussed, the random numbers may come from one or more random number generators. At a step 648 the wager may be collected or a winning amount paid to the player depending on the outcome of the game produced by the first game engine.

Concurrently (as shown by the branch after step 608 in FIG. 6), at a decision step 612 a comparision is made between a second random number generator and a predetermined number or range of numbers to determine whether or not to switch to another game engine for one or more subsequent games. For example, as discussed above, activation of the switch game engine may result in a random number being generated, such as by a random number generator associated with the switch game engine. If the random number matches one or more previously selected matching numbers, a switch may be made. If not, the same game engine may continue to be used for one or more subsequent games.

At decision step 612, if no switch is to be made (e.g., random number does not match a matching number), another wager may be accepted at step 604 and the first game engine may be activated to provide an outcome at step 608 and step 644. If a switch is to be made (e.g., random number matches a matching number), then the switch game engine may indicate or cause the gaming machine to utilize another game engine for one or more subsequent games at a step 616. For example, the switch game engine may cause game processing or presentation to occur at a second game engine for one or more subsequent games.

At a step 620, a wager may be accepted from a player (which may be the same player as before or a new player). At a step 624, the second game engine may be activated to produce a game outcome. At a step 628, this outcome may be evaluated, such as to determine whether the player has achieved a winning or losing outcome. At a step 632, the wager may be collected for a losing outcome, or the player may be paid a winning amount for a winning outcome.

At a decision step 636, it may be determined whether or not a subsequent game will utilize the first game engine or the second game engine. If the second game engine is to be used, then a wager may be collected at step 620 and another game played with the second game engine at step 624, step 628, and step 632 such as discussed above. If the first game engine is to be used, then a wager may be accepted at step 604 and another game may be played with the first game engine at step 608, step 644, and 648 such as described above.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A gaming machine configured to present one or more wagering games, the gaming machine comprising:

a plurality of game engines that are each configured to present one or more wagering games at the gaming machine upon receipt to a wager from a player, each of the plurality of game engines being configured with different odds for receiving a winning outcome;

one or more first random number generators configured to generate one or more first random numbers for the plurality of game engines to use in determining an outcome for the one or more first wagering games;

one or more second random number generators that are different from the one or more first random number generators and that are configured to generate one or more second random numbers within a range; and at least one switch game engine having one or more predetermined numbers, the at least one switch game engine being configured to switch from a first game engine of the plurality of game engines presenting one or more first wagering games with a first odds to activate a second game engine of the plurality of game engines based on a comparison between the one or more second random numbers and the one or more predetermined numbers, wherein the second game engine is used to present one or more second wagering games at the gaming machine upon receipt of a wager from the player, the one or more second wagering games having a second odds for receiving a winning outcome that are different than the first odds for receiving a winning outcome for an identical wager, the second odds being 90% or higher for receiving a winning outcome for an identical wager, wherein the first wagering game and the second wagering game use a same pay table, the pay table defining outcomes which are winning outcomes, outcomes which are losing outcomes, and an award amount for each winning outcome including a maximum award amount, and wherein the one or more first wagering games and the one or more second wagering games are each a base game of the gaming machine and presenting the base wagering game with the first odds comprises displaying one or more first game outcomes with a first set of reel strips, and presenting the base wagering game with the second odds comprises displaying one or more second game outcomes with a second set of reel strips, the second set of reel strips being different than the first set of reel strips.

2. The gaming machine of claim 1, wherein the one or more first random number generators and the one or more second random number generators are both configured to generate random numbers at the same time for each wagering game.

3. The gaming machine of claim 1, wherein the one or more second random number generators generate the one or more second random numbers upon the occurrence of a triggering event selected from the group consisting of: receipt of a wager from a player, a start of a new wagering game, and receipt of a wager of at least a particular predefined amount.

4. The gaming machine of claim 1, wherein the at least one switch game engine is configured to activate another one of the plurality of game engines after the activated game engine has presented a predefined number of wagering games.

5. The gaming machine of claim 4, wherein the predefined number of wagering games is a random number.

6. The gaming machine of claim 1, wherein each of the plurality of game engines are configured to present the one or more first wagering games according to identical game rules.

7. The gaming machine of claim 1, wherein the first wagering game and the second wagering game are a same game.

8. The gaming machine of claim 1, wherein each of the plurality of game engines comprise machine readable code configured to execute on a processor, the machine readable code configured to present the one or more first wagering games to a player and wherein each game engine has machine readable code that is different from at least one other game engine to thereby establish different game engines as presenting games with at least one aspect different from another game engine.

9. A gaming machine comprising:

one or more processors configured to execute machine readable code;

a first random number generator configured to generate a first random number;

a second random number generator that is different than the first random number generator and that is configured to generate a second random number; and machine readable code stored on non-transitory machine readable memory, the machine readable code configured as a first game engine, a second game engine, and a first switch game engine;

a display configured to display reel strips to present the first base wagering game to a player;

a player input device in communication with the one or more processor and configured to receive player input from the player;

the first game engine being configured to receive and process the first random number and present a first base wagering game upon receipt of a wager from a player with first odds of receiving a winning outcome resulting in a payout based on a paytable, the first base wagering game having one or more first game outcomes, at least one of which is a non-winning outcome and at least one of which is a winning outcome, the at least one winning outcome being a trigger outcome;

the second game engine being configured to receive and process the second random number and present the first base wagering game upon receipt of a wager from a player with second odds of receiving a winning outcome resulting in a payout based on the paytable, such that the second odds are at least 90% chance of receiving a winning outcome;

the first switch game engine being configured to process the outcome of the first base wagering game to determine if it is the trigger outcome, and responsive to the outcome of the first base wagering game being the trigger outcome, controlling the first base wagering game presented to the player to have the second odds, the first odds being different than the second odds and the paytable for the first game engine and the second game engine defining the same winning outcomes and the same payout amounts including a maximum payout amount for an identical wager when receiving a winning outcome; and wherein presenting the first base wagering game with the first odds of receiving a winning outcome comprises displaying one or more first game outcomes with a first set of reel strips, and presenting the first base wagering game with the second odds, using the second game engine, comprises displaying one or more second game engine outcomes with a second set of reel strips, the second set of reel strips being different than the first set of reel strips.

10. The gaming machine of claim 9, wherein each of the game engines comprise a set of associated game symbols, each set of game symbols being unique from other sets of game symbols.

11. The gaming machine of claim 9, wherein at least one of the first and second game engines comprises a set of predefined combinations of game symbols, the at least one of the first and second game engines being configured to present each of the set of predefined combinations of game symbols individually.

12. The gaming machine of claim 11, wherein the first switch game engine is configured to activate the other of the first or second game engines after each of the set of predefined combinations of game symbols has been presented by the at least one of the first and second game engines.

13. The gaming machine of claim 9, wherein the first switch game engine is associated with the first game engine, and a second switch game engine is associated with the second game engine, wherein the second switch game engine activates the second game engine after the first game engine presents the first wagering game.

14. The gaming machine of claim 9, wherein the machine readable code is further configured as a plurality of game engines that includes the first game engine, the second game engine, and a last game engine, and one or more switch game engines that includes the first switch game engine, whereby the one or more switch game engines are configured to activate the first game engine after one or more wagering games have been presented by the last game engine.

15. A method of presenting a base wagering game at a gaming machine comprising:

providing a first game engine that is configured to present the base wagering game with first odds of receiving a winning outcome and a second game engine that is configured to present the base wagering game with second odds of receiving a winning outcome, the second odds being different than the first odds;

accepting a wager from a player via a player input device of the gaming machine;

presenting, on a gaming machine display screen using at least one processor, the base wagering game with the first odds of receiving a winning outcome using the first game engine, wherein the outcome of the base wagering game is based on a random number associated with the first game engine;

detecting, using the at least one processor, a triggering event;

generating a triggering event random number within a range of numbers in response to the triggering event;

comparing, using the at least one processor, the triggering event random number to one or more predetermined numbers;

upon matching the triggering event random number to the one or more predetermined numbers, presenting on the gaming machine display screen the base wagering game with the second game engine with the second odds of receiving a winning outcome for a predetermined number of games, an additional wager being accepted from the player via a player input device of the gaming machine for each of the predetermined number of games, and the second odds substantially ensuring a winning outcome in each of the predetermined number of games; and providing a payout to the player upon occurrence of a winning outcome, wherein, for an identical wager, the base wagering game presented with the second odds of receiving a winning outcome use a paytable that has the same winning outcomes and award amounts, including a maximum award amount, as a paytable that is used to present the base wagering game with the first odds, and wherein presenting the base wagering game with the first odds comprises displaying one or more first game outcomes with a first set of reel strips, and presenting the base wagering game with the second odds comprises displaying one or more second game outcomes with a second set of reel strips, the second set of reel strips being different than the first set of reel strips.

16. The method of claim 15, wherein detecting a triggering event comprises detecting the start of a new wagering game.

17. The method of claim 15, wherein the second odds have a higher likelihood of a player receiving a winning outcome than the first odds to thereby increase an effective payout without increasing the maximum award on the paytable.

18. The method of claim 15 further comprising:

accepting additional wagers; and presenting the base wagering game with the first game engine after the predetermined number of games.

19. The method of claim 15 further comprising:

providing a third game engine configured to present the base wagering game with identical paytables as the first game engine and the second game engine; and upon matching the triggering event random number to one or more other predetermined numbers, presenting the one or more third wagering games using the third game engine with a third odds of receiving a winning outcome, the third odds being different than the first odds and the second odds.

* * * * *